United States Patent [19]

Mollerus et al.

[11] Patent Number: 4,619,121

[45] Date of Patent: Oct. 28, 1986

[54] SEAL FOR TUNNEL WASHING MACHINES

[76] Inventors: Alexander Mollerus; Robert Mollerus, both of Friedhofstr. 13, D-7128 Lauffen, Fed. Rep. of Germany

[21] Appl. No.: 658,601

[22] Filed: Oct. 9, 1984

[30] Foreign Application Priority Data

Oct. 14, 1983 [DE] Fed. Rep. of Germany ..... 3337236

[51] Int. Cl.[4] ..... D06F 21/02; D06F 37/04

[52] U.S. Cl. ..... 68/16; 68/58; 68/142

[58] Field of Search ..... 68/58, 142, 143, 15, 68/16; 134/120, 114; 34/135, 136, 137; 366/40; 277/67, 68, 89

[56] References Cited

U.S. PATENT DOCUMENTS

| | | | |
|---|---|---|---|
| 759,659 | 5/1904 | Braungart, Jr. | 277/68 X |
| 2,264,646 | 12/1941 | Spears | 34/135 |
| 2,437,179 | 3/1948 | Wheeler | 68/58 X |
| 2,882,075 | 4/1959 | Biering et al. | 277/68 X |
| 3,703,296 | 11/1972 | Malmstrom | 277/67 X |
| 3,707,858 | 1/1973 | Gulzow et al. | 68/143 |
| 3,895,811 | 7/1975 | Richard, Jr. et al. | 277/67 X |
| 3,969,913 | 7/1976 | Schaper | 68/143 |

*Primary Examiner*—Philip R. Coe

*Attorney, Agent, or Firm*—Burton, Parker & Schramm

[57] ABSTRACT

The present invention concerns a seal for addition and/or removal of gaseous or liquid media in a tunnel washing machine, with which two sealing gaskets are arranged on a fixed trough for the receiving of units.

11 Claims, 2 Drawing Figures

SEAL FOR TUNNEL WASHING MACHINES

BACKGROUND

The present invention concerns tunnel washing machines.

These kinds of tunnel washing machines consist of cylinders to be arranged lying horizontally, in which laundry is washed on an industrial scale.

In order to add gaseous or liquid media to these machines, known tunnel washing machines possess inwardly directed sealing gaskets arranged lying against one another on welded on rings. Between the gaskets, spear shaped injectors are installed. With rotation of the machine, these seals rub on the projectings spears.

This solution has disadvantages. On the one hand, the space formed by the gaskets is relatively small. On the other hand, the gaskets are very susceptible to high proportions of sand with severely soiled laundry.

Finally, it is required to change all of the gaskets with wear.

SUMMARY OF THE INVENTION

The present invention has faced the problem of producing a sealing system that allows a place for the housing of external equipment (heating), and with which the gaskets need not be completely discarded due to wear.

This problem is solved by a seal for the addition or removal of gaseous or liquid media in a rotating tunnel washing machine by means of sealing gaskets arranged on the tunnel, between which the tunnel has perforations, and with which, between the gaskets, a trough is arranged surrounding the tunnel at least up to the height of the water level, against whose vertical sides the gaskets lie.

The trough surrounds the tunnel washing machine preferably at least up to the water level, in order not to allow steam to go completely to the outside. The trough is thereby open to the tunnel casing.

In this way it is possible for the first time, to so increase the distances of the sealing gaskets from each other that the necessary units can be built into the circulating water outside of the tunnel, without constructive expense.

Thus, now an entire heating system, e.g. in the form of coils, can be built in, whereby the heat transfer through the wall of the coil proceeds, whereas with the present state of the technique, steam injectors of only limited diameter must be used.

Furthermore, it is proposed to mount removable wear rings on the gaskets. These rub tightly on the vertical sides of the trough and, if need be, can be removed from the gaskets and changed.

In the trough, for the first time, a sand trap in the form of a sump can be arranged, with whose help coarse, non-dispersable substances can be removed.

In order to keep these coarse particles far from the sensitive (delicate) sealing surfaces, it is finally proposed to arrange deflector plates on the tunnel, directed inside the trough.

BRIEF DESCRIPTION OF DRAWINGS

By means of the following description of the figures, the present invention is explained in detail.

They show.

DETAILED DESCRIPTION OF EMBODIMENTS

Figure 1:
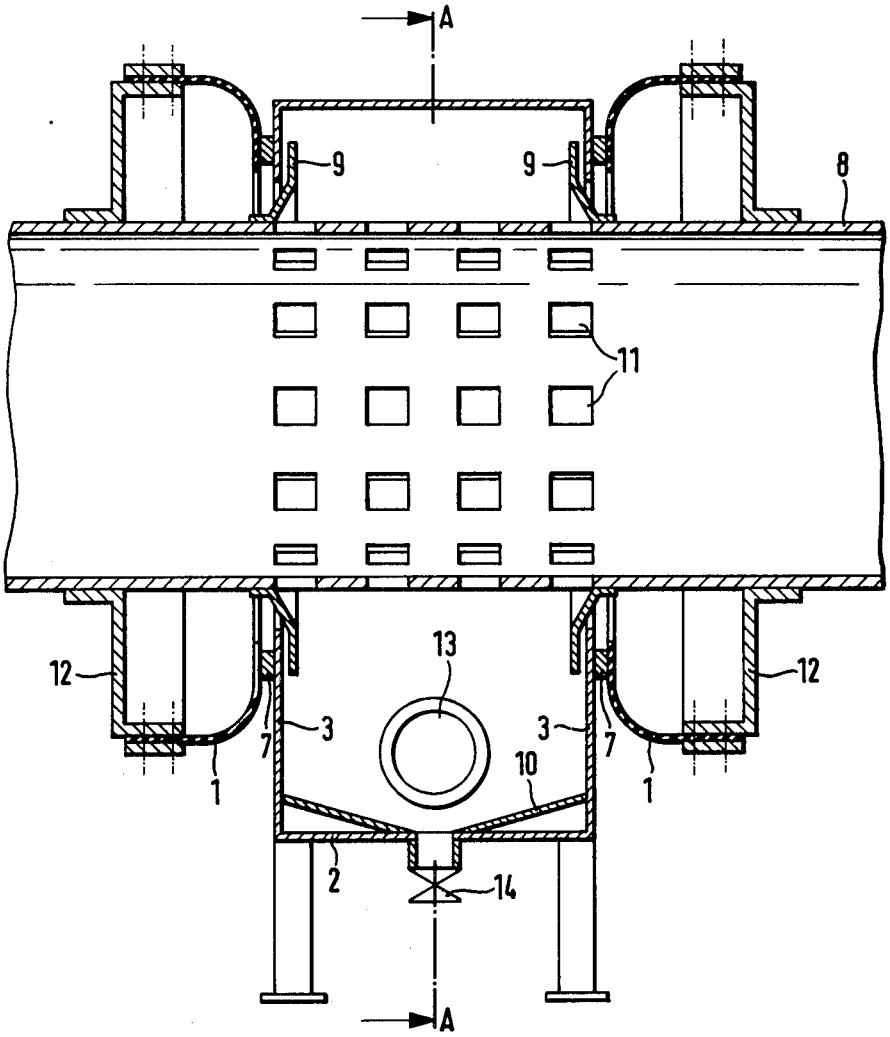
FIG. 1. A lengthwise section through the seal.

The sealing gaskets 1 are fastened on the rings 12 surrounding the tunnel 8; these lie against the vertical sides of the trough 2. With rotation of the tunnel they slide on the sides 3 and seal the wet space from the outside. A discharge (not presented) can be provided for in the rings 12.

The washing liquid thereby presses the gaskets against the sides 3, and takes care of cooling and lubrication. The trough itself is stationary, and is supported on the foundation of the building holding the machine.

A large volume steam feed line (13) or a heating coil system (4) can be arranged in the trough 2. Through the bottom discharge 14, liquid, or with construction and use of the trough 2 as a sump, e.g. with the sloping bottom 10, coarse dirt can be withdrawn.

Sealing rings 7 on the gaskets 1 are presented, which can be changed after wear.

Inside the trough 2, the tunnel has perforations 11, at whose edges deflector plates 9 can be fastened, in order to hinder the dirt to be removed from arriving between the sealing surfaces moving relative to each other.

Figure 2:
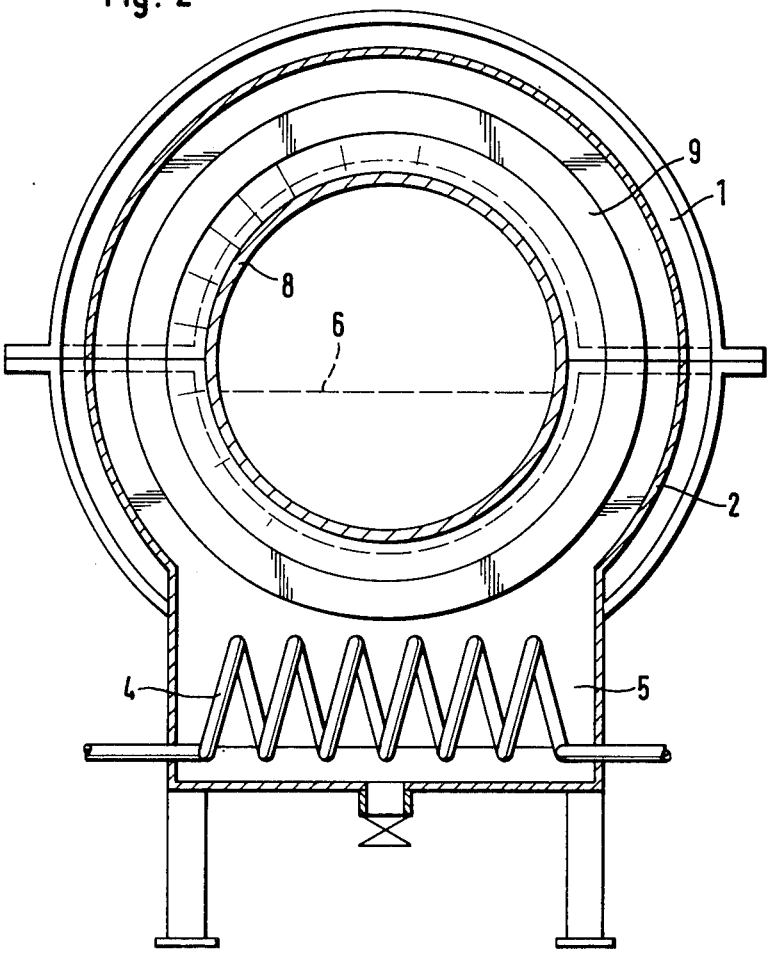
FIG. 2. A cross section.

FIG. 2 shows the cross section of the tunnel 8 in the cut A—A. The trough is widened here in such a way that a heating coil 4 is located in place. The trough does not surround the tunnel 8 completely in this presentation, but ends above the bath level 6.

We claim:

1. A rotating tunnel washing machine, comprising:

a rotatable cylindrical tunnel provided with a central region having a plurality of perforations formed therethrough;

a housing circumaxially surrounding a portion of the external periphery of the tunnel, said housing having first and second side walls, on respective sides of the tunnel central region defining an annular trough about said tunnel for retaining a washing fluid; and first and second gaskets sealingly cooperating with said tunnel, affixed outside of the housing, the first gasket adjacent the first side wall and the second gasket adjacent the second side wall, each gasket defining an annular gasket cavity about the tunnel and provided with a section thereof maintained in fluid-tight contact with the side wall by the pressure of the washing fluid.

2. The invention of claim 1 further comprising first and second wear rings respectively attached to the first and second gaskets for sealingly engaging the first and second side walls of the housing respectively.

3. The invention of claim 1 wherein the trough formed by the housing is further provided with an enlarged bottom region below the tunnel forming a tank for accumulation of washing fluid.

4. The invention of claim 3 wherein the tank is further provided with means for heating the washing fluid.

5. The invention of claim 3 wherein the tank is further provided with valve means for removing and admitting fluid into the tank.

6. The invention of claim 5 wherein the tank is further provided with a tapered bottom forming a stump to accumulate non-dispersable dirt adjacent the valve means.

7. The invention of claim 1 further comprising first and second deflector plates affixed to said tunnel on respective sides of the central region within the housing adjacent to the first and second side walls respectively, said deflector plates projecting outward radially from the tunnel for preventing dirt particles from contacting the gaskets.

8. The invention of claim 1 further comprising first and second gasket mounting rings concentrically affixed to the tunnel on respective sides thereof and projecting outward therefrom for the respective attachment of the first and second gaskets to the outer periphery of said gasket mounting rings.

9. The invention of claim 8 wherein said gaskets project radially inward from their respective gasket mounting ring to define the annular gasket cavity bounded generally by the tunnel, the gasket mounting ring and the gasket, said gasket is pressed against the housing wall by the pressure of the washing fluid within the annular cavity.

10. A rotating tunnel washing machine comprising:

a rotatable cylindrical tunnel provided with a central region having a plurality of perforations formed therethrough;

a housing circumaxially surrounding the periphery of the tunnel central region, said housing having first and second side walls, on respective sides of the tunnel central region defining an annular trough about said tunnel for retaining a wash fluid, said trough being enlarged below the tunnel to establish a tank for retaining a washing fluid;

first and second gaskets, and first and second gasket mounting rings, said gasket mounting rings concentrically affixed to the tunnel on respective sides thereof and projecting outward therefrom for the respective attachment of the first and second gaskets to the outer periphery of said gasket mounting rings, said first and second gaskets affixed to said first and second mounting rings respectively and projecting radially inwardly, each gasket defining an annular gasket cavity bounded generally by the tunnel, the gasket mounting ring and the gasket, said gasket being pressed against the respective housing wall by the pressure of the washing fluid within the annular cavity; and first and second deflector plates affixed to said tunnel on respective sides of the central region within the housing adjacent to the first and second side wall respectively, said deflector plates projecting outward radially from the tunnel for preventing dirt particles from contacting the gaskets.

11. A seal for maintaining a fluid-tight connection between a rotating tunnel and a fixed housing having a wall generally perpendicular to said tunnel, comprising:

a gasket mounting ring affixed to and concentrically extending about the outer periphery of the tunnel; and a tubular gasket having a first and second end, the first end affixed to said gasket mounting ring and the second end sealingly cooperating with the housing wall to form an annular gasket cavity for retention of a fluid, the second end of the tubular gasket projecting radially inward so that pressure of the fluid maintains the second end of the tubular gasket in contact with the housing wall.

* * * * *